US012168933B1

(12) United States Patent
Barberger et al.

(10) Patent No.: US 12,168,933 B1
(45) Date of Patent: Dec. 17, 2024

(54) IMPINGEMENT COOLING ASSEMBLY FOR AN AIRCRAFT ROTARY ENGINE HOUSING

(71) Applicant: Pratt & Whitney Canada Corp., Longueuil (CA)

(72) Inventors: Jeremie Barberger, Montreal (CA); Mathias Michaud, Drummondville (CA); Michel Bousquet, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/512,779

(22) Filed: Nov. 17, 2023

(51) Int. Cl.
*F01C 21/06* (2006.01)

(52) U.S. Cl.
CPC ..... *F01C 21/06* (2013.01); *F04C 2270/195* (2013.01)

(58) Field of Classification Search
CPC ..... F01C 21/06; F04C 2270/195; F02B 55/10
USPC ..... 418/60, 61 A, 83; 123/242
See application file for complete search history.

(56) References Cited

U.S. PATENT DOCUMENTS

| | | | | |
|---|---|---|---|---|
| 3,280,802 | A * | 10/1966 | Froede | F02B 55/10 418/91 |
| 3,298,330 | A * | 1/1967 | Ryusuke | F02B 53/00 418/104 |
| 3,969,048 | A * | 7/1976 | Dobler | F02B 55/10 418/83 |
| 6,481,989 | B2 * | 11/2002 | Eiermann | F02B 55/00 418/83 |
| 10,072,566 | B2 | 9/2018 | Bruno | |
| 11,613,995 | B2 | 3/2023 | Gagnon-Martin | |
| 11,761,376 | B1 | 9/2023 | Johnny | |

* cited by examiner

*Primary Examiner* — J. Todd Newton
(74) *Attorney, Agent, or Firm* — Getz Balich LLC

(57) ABSTRACT

An engine housing includes a rotor housing and a side housing assembly. The rotor housing extends about an axis to form a rotor cavity of the engine housing. The side housing assembly includes a side housing body, a side plate, and an impingement cooling assembly. The side plate is disposed between the rotor housing and the side housing body. The side plate forms the rotor cavity. The impingement cooling assembly includes a first baffle plate. The first baffle plate is disposed between the side housing body and the side plate. The side housing body, the side plate, and the first baffle plate form a coolant passage. The coolant passage includes an inlet plenum and a plurality of impingement cooling holes. The first baffle plate forms the plurality of impingement cooling holes. Each impingement cooling hole of the plurality of impingement cooling holes is disposed at the inlet plenum.

20 Claims, 7 Drawing Sheets

IMPINGEMENT COOLING ASSEMBLY FOR AN AIRCRAFT ROTARY ENGINE HOUSING

TECHNICAL FIELD

This disclosure relates generally to rotary engines for aircraft and, more particularly, to an impingement cooling assembly for a rotary engine housing.

BACKGROUND OF THE ART

A rotary engine for an aircraft may be configured, for example, as a Wankel engine. The rotary engine includes one or more rotors configured to eccentrically rotate within an engine housing. The engine housing may be exposed to high temperatures during operation of the rotary engine. Various methods and engine housing configurations are known in the art for mitigating high-temperature conditions for rotary engines housings. While these known methods and engine housing configurations have various advantages, there is still room in the art for improvement.

SUMMARY

It should be understood that any or all of the features or embodiments described herein can be used or combined in any combination with each and every other feature or embodiment described herein unless expressly noted otherwise.

According to an aspect of the present disclosure, an engine housing for an aircraft rotary engine includes a rotor housing and a side housing assembly. The rotor housing includes a rotor housing body. The rotor housing body extends about an axis to form a rotor cavity of the engine housing. The rotor housing body extends between and to a first axial end and a second axial end. The side housing assembly includes a side housing body, a side plate, and an impingement cooling assembly. The side housing body is disposed at the first axial end. The side plate is disposed axially between the rotor housing body and the side housing body. The side plate includes an inner side, an outer side, and a perimeter edge extending from the inner side to the outer side. The inner side further forms the rotor cavity. The impingement cooling assembly includes a first baffle plate. The first baffle plate is disposed between the side housing body and the side plate. The side housing body, the side plate, and the first baffle plate form a coolant passage of the impingement cooling assembly. The coolant passage includes an inlet plenum and a plurality of impingement cooling holes. The first baffle plate forms the plurality of impingement cooling holes. Each impingement cooling hole of the plurality of impingement cooling holes includes a cooling hole inlet and a cooling hole outlet. The cooling hole inlet is disposed at the inlet plenum. Each impingement cooling hole of the plurality of impingement cooling holes is configured to direct a coolant from the inlet plenum toward and onto the outer side from the cooling hole outlet.

In any of the aspects or embodiments described above and herein, the inlet plenum may be formed by the side housing body and the first baffle plate.

In any of the aspects or embodiments described above and herein, the coolant passage may further include an outlet plenum. The outlet plenum may be formed by the first baffle plate and the side plate.

In any of the aspects or embodiments described above and herein, the cooling hole outlet may be disposed at the outlet plenum.

In any of the aspects or embodiments described above and herein, the impingement cooling assembly may further include a second baffle plate disposed between the side housing body and the side plate. The second baffle plate may be axially spaced from the first baffle plate. The coolant passage may further include an outlet plenum. The outlet plenum may be formed by one or both of the first baffle plate and the second baffle plate.

In any of the aspects or embodiments described above and herein, the inlet plenum may be formed by and between the first baffle plate and the second baffle plate.

In any of the aspects or embodiments described above and herein, the outlet plenum may be formed by and between the first baffle plate and the second baffle plate.

In any of the aspects or embodiments described above and herein, the side housing body, the side plate, the first baffle plate, and the second baffle plate may form a plurality of coolant cells of the impingement cooling assembly. Each coolant cell of the plurality of coolant cells may include at least one impingement cooling hole of the plurality of impingement cooling holes, one or more coolant outlet holes, and an impingement cooling cavity. The at least one impingement cooling hole may extend between and connect the inlet plenum and the impingement cooling cavity. The one or more coolant outlet holes may extend between and connect the outlet plenum and the impingement cooling cavity. The impingement cooling cavity may be disposed at the outer side.

In any of the aspects or embodiments described above and herein, the at least one impingement cooling hole may extend through one of the first baffle plate or the second baffle plate.

In any of the aspects or embodiments described above and herein, the at least one impingement cooling hole may extend through the first baffle plate and the second baffle plate.

In any of the aspects or embodiments described above and herein, the impingement cooling cavity sidewall may extend between and to the second baffle plate and the side plate. The impingement cooling cavity sidewall may circumscribe the impingement cooling cavity.

In any of the aspects or embodiments described above and herein, the side housing body, the side plate, and the first baffle plate may form a unitary structure.

In any of the aspects or embodiments described above and herein, the impingement cooling assembly may further include a second baffle plate disposed between the side housing body and the side plate. The second baffle plate further may form the unitary structure.

In any of the aspects or embodiments described above and herein, the second baffle plate may be axially spaced from the first baffle plate. The coolant passage may further include an outlet plenum. The outlet plenum may be formed by one or both of the first baffle plate and the second baffle plate.

According to another aspect of the present disclosure, an engine housing for an aircraft rotary engine includes a side housing assembly. The side housing assembly extends along an axis. The side housing assembly includes a side housing body, a side plate, and an impingement cooling assembly. The side housing body and the side plate extend about the axis. The side plate includes an inner axial side, an outer axial side, and a perimeter edge extending from the inner axial side to the outer axial side. The outer axial side is disposed at the side housing body. The impingement cooling assembly includes a baffle plate. The baffle plate, the side housing body, and the side plate form a coolant passage of the impingement cooling assembly axially between the side housing body and the outer axial side. The coolant passage extends about the axis. The coolant passage includes an inlet plenum and a plurality of impingement cooling holes. The baffle plate forms the plurality of impingement cooling holes. Each impingement cooling hole of the plurality of impingement cooling holes includes a cooling hole inlet and a cooling hole outlet. The cooling hole inlet is disposed at the inlet plenum. Each impingement cooling hole of the plurality of impingement cooling holes is configured to direct a coolant from the inlet plenum toward and onto the outer side from the cooling hole outlet.

In any of the aspects or embodiments described above and herein, each impingement cooling hole of the plurality of impingement cooling holes extends axially from the cooling hole inlet to the cooling hole outlet to direct the coolant orthogonally toward and onto the outer side.

In any of the aspects or embodiments described above and herein, the baffle plate forms a nozzle for each impingement cooling hole of the plurality of impingement cooling holes at the cooling hole outlet. The nozzle may extend toward the outer side relative to a surrounding portion of the baffle plate.

According to another aspect of the present disclosure, an engine housing for an aircraft rotary engine includes a rotor housing and a side housing assembly. The rotor housing includes a rotor housing body. The rotor housing body extends about an axis to form a rotor cavity of the engine housing. The side housing assembly includes a side housing body, a side plate, and an impingement cooling assembly. The side housing body is disposed mounted to the rotor housing body. The side plate is disposed axially between the rotor housing body and the side housing body. The side plate includes an inner side and an outer side. The inner side further forms the rotor cavity. The impingement cooling assembly includes at least one baffle plate. The at least one baffle plate is disposed axially between the side housing body and the side plate. The side housing body, the side plate, and the at least one baffle plate form a coolant passage of the impingement cooling assembly. The coolant passage includes a plurality of impingement cooling holes, an inlet plenum upstream of the plurality of impingement cooling holes, and an outlet plenum downstream of the plurality of impingement cooling holes. The at least one baffle plate separates the inlet plenum from the outlet plenum. Each impingement cooling hole of the plurality of impingement cooling holes includes a cooling hole inlet and a cooling hole outlet. The cooling hole inlet is disposed at the inlet plenum. Each impingement cooling hole of the plurality of impingement cooling holes is configured to direct a coolant from the inlet plenum toward and onto the outer side from the cooling hole outlet.

In any of the aspects or embodiments described above and herein, the side housing body, the side plate, and the at least one baffle plate may form a unitary structure.

In any of the aspects or embodiments described above and herein, the at least one baffle plate may include a first baffle plate and a second baffle plate axially spaced from the first baffle plate.

The present disclosure, and all its aspects, embodiments and advantages associated therewith will become more readily apparent in view of the detailed description provided below, including the accompanying drawings.

DETAILED DESCRIPTION

Figure 1:
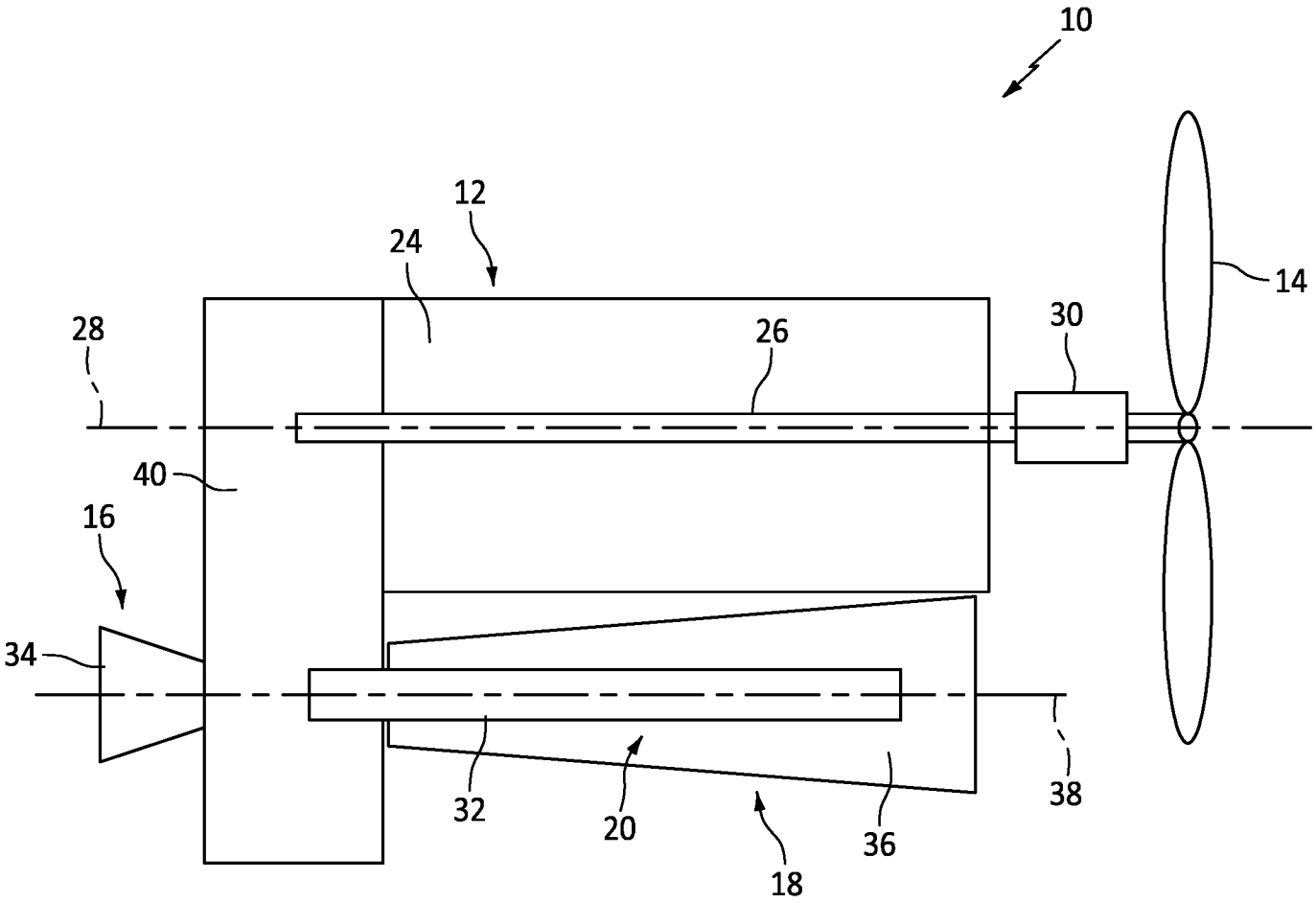
FIG. 1 illustrates a schematic view of an engine assembly, in accordance with one or more embodiments of the present disclosure.

FIG. 1 illustrates an engine assembly 10. The engine assembly 10 may form a portion of a propulsion system for an aircraft. Briefly, the aircraft may be a fixed-wing aircraft (e.g., an airplane), a rotary-wing aircraft (e.g., a helicopter), a tilt-rotor aircraft, a tilt-wing aircraft, or another aerial vehicle. Moreover, the aircraft may be a manned aerial vehicle or an unmanned aerial vehicle (UAV, e.g., a drone). The engine assembly 10 may also form a portion of an auxiliary power unit (APU) or onboard generator for an aircraft. However, the present disclosure is not limited to any particular application of the engine assembly 10. The engine assembly 10 of FIG. 1 includes an engine 12, a rotational load 14, a compressor section 16, a turbine section 18, and a rotational assembly 20.

The engine 12 of FIG. 1 is configured as a rotary intermittent internal combustion engine, which intermittent internal combustion engine includes a rotor assembly 24 and an engine shaft 26. As will be described in further detail, the rotor assembly 24 may be configured, for example, as a Wankel engine in which an eccentric rotor configuration is used to convert fluid pressure into rotational motion.

The rotor assembly 24 is coupled to the engine shaft 26 and configured to drive the engine shaft 26 for rotation about a rotational axis 28. The engine shaft 26 is coupled to the rotational load 14 such that rotation of the engine shaft 26 by the rotor assembly 24 drives rotation of the rotational load 14. The engine shaft 26 may be coupled to the rotational load 14 by a speed-reducing gear assembly 30 of the engine 12. The speed-reducing gear assembly 30 may be configured to effect rotation of the rotational load 14 at a reduced rotational speed relative to the engine shaft 26. The rotational load 14 of FIG. 1 is configured as a propeller. Rotation of the propeller by the engine 12 may generate thrust for an aircraft which includes the engine assembly 10. The engine assembly 10 of the present disclosure may additionally or alternatively be configured to drive other rotational loads, such as, but not limited to, an electrical generator(s), a rotational accessory load, a rotor mast, a compressor, or any other suitable rotational load configuration.

The rotational assembly 20 of FIG. 1 includes a shaft 32, a bladed compressor rotor 34 of the compressor section 16, and a bladed turbine rotor 36 of the turbine section 18. The shaft 32 interconnects the bladed compressor rotor 34 and the bladed turbine rotor 36. The shaft 32, the bladed compressor rotor 34, and the bladed turbine rotor 36 are mounted to rotation about a rotational axis 38. Ambient air is received by the compressor section 16. The air is compressed by rotation of the bladed compressor rotor 34 and directed to an air intake of the engine 12. Combustion exhaust gases from the engine 12 are directed to the turbine section 18 causing the bladed turbine rotor 36 to rotate and rotationally drive the rotational assembly 20. The engine shaft 26 and the rotational assembly 20 may be rotatably coupled by a gearbox 40 of the engine assembly 10, thereby allowing the engine 12 and/or the bladed turbine rotor 36 to rotationally drive the bladed compressor rotor 34. The present disclosure, however, is not limited to the particular engine 12 and rotational assembly 20 configuration of FIG. 1.

Figure 2:
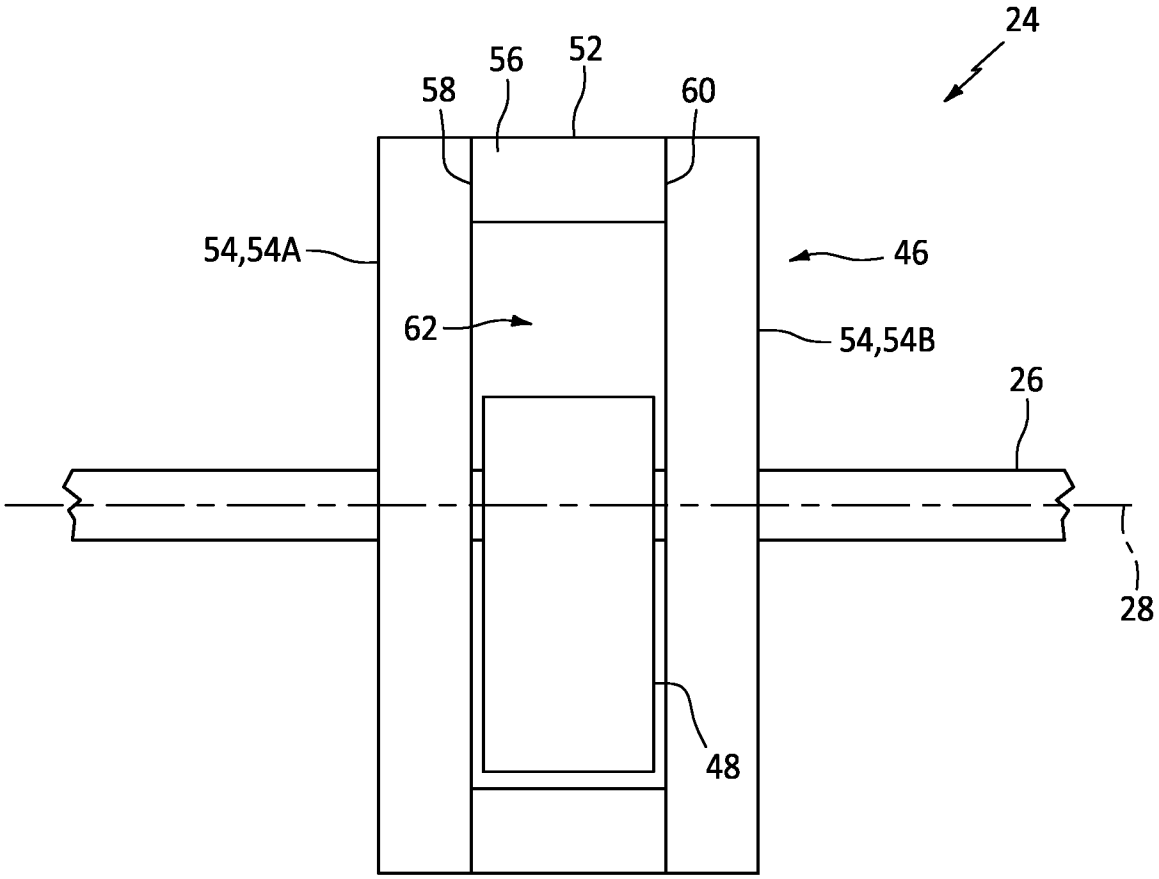
FIG. 2 illustrates a cutaway view of a rotor assembly for the engine assembly of FIG. 1, in accordance with one or more embodiments of the present disclosure.
Figure 3:
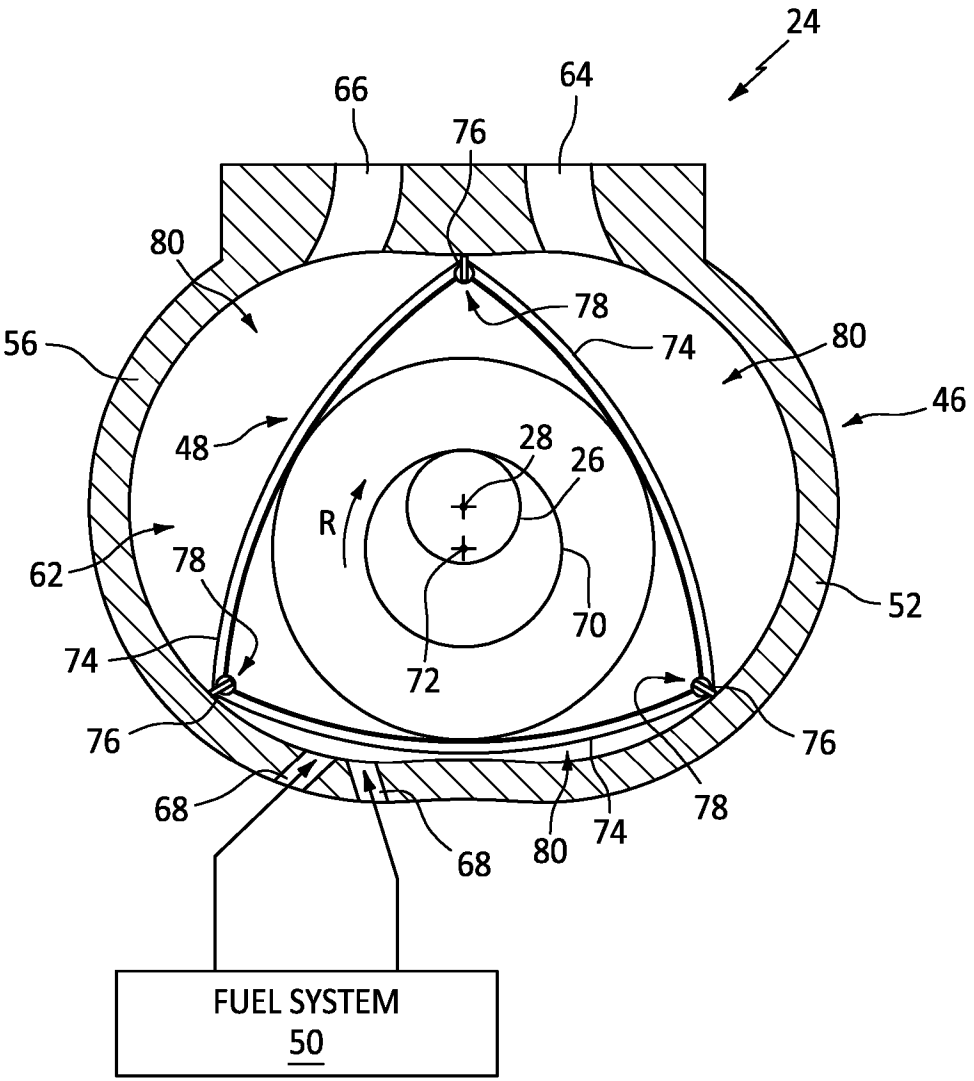
FIG. 3 illustrates a cutaway axial view of the rotor assembly of FIG. 2, in accordance with one or more embodiments of the present disclosure.

Referring to FIGS. 2 and 3, the rotor assembly 24 includes an engine housing 46, one or more rotors 48, and a fuel system 50. FIG. 2 illustrates a side, cutaway view of the rotor assembly 24. FIG. 3 illustrates a cutaway view of the rotor assembly 24 at an axial position relative to the rotational axis 28. The rotor assembly 24 of FIG. 2 includes a single rotor 48, however, the present disclosure is not limited to any particular number of rotors 48 for the rotor assembly 24. For example, the rotor assembly 24 may alternatively include a plurality of rotors 48.

The engine housing 46 of FIGS. 2 and 3 includes a rotor housing 52 and opposing side housing assemblies 54. The rotor housing 52 includes a rotor housing body 56 extending (e.g., axially extending) between and to a first end 58 of the rotor housing body 56 and a second end 60 of the rotor housing body 56. The rotor housing body 56 may extend about (e.g., completely around) the rotational axis 28. The rotor housing body 56 includes a rotor housing body material. The rotor housing body material may form all or a substantial portion of the rotor housing body 56. The rotor housing body material may be metal such as, but not limited to aluminum. The present disclosure, however, is not limited to the use of a particular material or combination of materials for the rotor housing body material.

The rotor housing body 56 of FIGS. 2 and 3 surrounds and forms a rotor cavity 62. The rotor cavity 62 of FIG. 3 is formed with two lobes, which two lobes may collectively be configured with an epitrochoid shape. The rotor housing body 56 further forms an intake port 64, an exhaust port 66, and one or more fuel system passages 68. The intake port 64 is in fluid communication with the rotor cavity 62. The intake port 64 is configured to direct compressed air to the rotor cavity 62, for example, from the compressor section 16 (see FIG. 1). The exhaust port 66 is in fluid communication with the rotor cavity 62. The exhaust port 66 is configured to direct combustion exhaust gas out of the rotor cavity 62. For example, the exhaust port 66 may be configured to direct the combustion exhaust gas from the rotor cavity 62 to the turbine section 18 (see FIG. 1). The fuel system passages 68 provide access to the rotor cavity 62 for a spark plug or other ignition device and/or for one or more fuel injectors of the fuel system 50.

The side housing assemblies 54 may be mounted to or otherwise disposed at (e.g., on, adjacent, or proximate) the first end 58 and the second end 60. For example, the side housing assemblies 54 may include a first side housing assembly 54A disposed at the first end 58 and a second side housing assembly 54B disposed at the second end 60. The side housing assemblies 54 further form the rotor cavity 62 (e.g., axial bounds of the rotor cavity 62). Each of the first side housing assembly 54A and the second side housing assembly 54B may include a respective shaft aperture (not shown) through which the engine shaft 26 may extend along the rotational axis 28 through the rotor cavity 62.

The rotor 48 of FIGS. 2 and 3 is coupled to an eccentric portion 70 of the engine shaft 26. The rotor 48 is disposed within the rotor cavity 62. The rotor 48 is configured to rotate (e.g., in rotation direction R) with the eccentric portion 70 about a rotational axis 72 of the rotor 48 to perform orbital revolutions within the rotor cavity 62. The rotational axis 72 may be offset from and parallel to the rotational axis 28.

Briefly, the rotor 48 of FIG. 3 includes three sides 74 and three apex seals 76. The sides 74 of the rotor 48 form a generally triangular cross-sectional shape of the rotor 48 (e.g., along a plane extending perpendicular to the rotational axis 72). The sides 74 may be configured with a convex curvature, which convex curvature faces away from the rotational axis 72. Each side 74 intersects each other side 74 at an apex portion 78 of the rotor 48. Each of the apex seals 76 is disposed at a respective one of the apex portions 78. Each apex portion 78 may include a slot, channel, or other attachment configuration for retaining a respective one of the apex seals 76. Each of the apex seals 76 extends outward (e.g., radially outward) from each respective one of the apex portions 78 toward the rotor housing body 56. The apex seals 76 may be configured as spring-loaded seals, which spring-loaded seals may be biased toward an outer radial position. Each of the apex seals 76 is configured to sealingly contact the rotor housing body 56, thereby forming three separate working chambers 80 of variable volume between the rotor 48 and the rotor housing body 56.

In operation of the engine 12, the fuel system 50 is configured to effect rotation of the rotor 48 by directing a fuel into the rotor cavity 62 and igniting the fuel in a defined sequence. During each orbital revolution of the rotor 48, each working chamber 80 varies in volume and moves about the rotor cavity 62 to undergo four phases of intake, compression, expansion, and exhaust, thereby driving rotation of the rotor 48 and the shaft 26.

Figure 4:
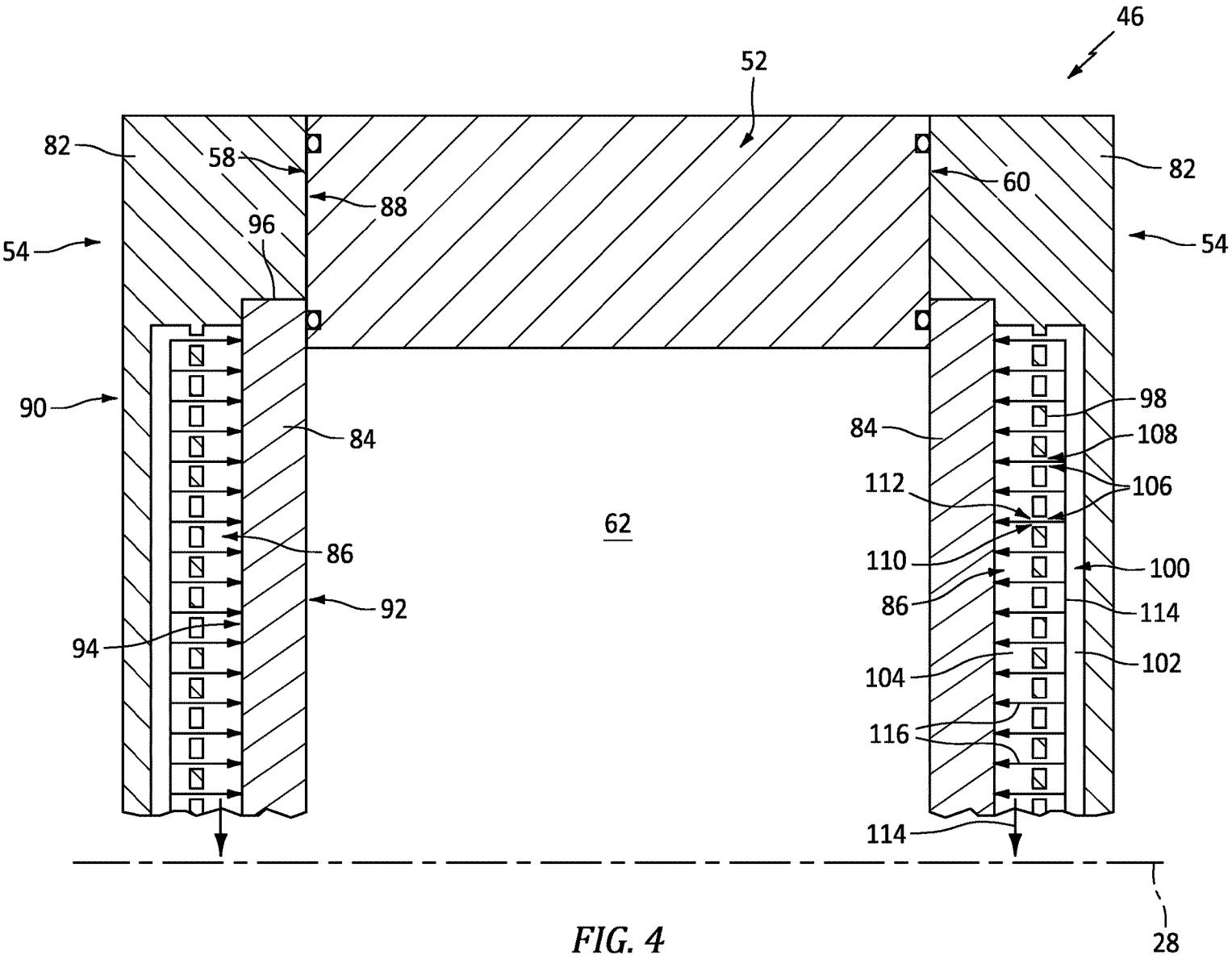
FIG. 4 illustrates a cutaway view of a portion of an engine housing for the rotor assembly of FIG. 2, in accordance with one or more embodiments of the present disclosure.

FIG. 4 illustrates a cutaway view of a portion of the engine housing 46 including the rotor housing 52 and the side housing assemblies 54. Each of the side housing assemblies 54 includes a side housing body 82, a side plate 84, and an impingement cooling assembly 86.

The side housing body 82 extends (e.g., axially extends) between and to an inner side 88 of the side housing body 82 and an outer side 90 of the side housing body 82. The side housing body 82 extends about (e.g., completely around) the rotational axis 28. The side housing body 82 includes a side housing body material. The side housing body material may form all or a substantial portion of the side housing body 82. The side housing body material may be metal or metal alloy material. For example, the side housing body material may be a lightweight metal or metal alloy material having a relatively high thermal conductivity such as, but not limited to aluminum. The present disclosure, however, is not limited to the use of a particular material or combination of materials for the side housing body material.

The side plate 84 extends (e.g., axially extends relative to the rotational axis 28) between and to an inner side 92 of the side plate 84 and an outer side 94 of the side plate 84. The side plate 84 extends about (e.g., completely around) the rotational axis 28. The side plate 84 includes a perimeter edge 96 circumscribing the inner side 92 and the outer side 94. The side plate 84 (e.g., the perimeter edge 96) may have an epitrochoid shape similar to that of the rotor cavity 62. The side plate 84 is disposed axially between the rotor housing body 56 and the side housing body 82. The inner side 92 faces the rotor 48 and forms a portion of the rotor cavity 62. The inner side 92 (e.g., at the perimeter edge 96) may be disposed in contact with the first end 58 or the second end 60 of the rotor housing body and the outer side 94 may be disposed in contact with the inner side 88. The side plate 84 includes a side plate material. The side plate material may form all or a substantial portion of the side plate 84. The side plate material may be a metal or metal alloy material. The side plate material may alternatively be a ceramic material such as, but not limited to, silicon carbide (SIC). The side plate material may be the same as or different than the side housing body material. For example, the side plate material may be a harder material relative to the side housing body material. The present disclosure, however, is not limited to the use of a particular material or combination of materials for the side plate material.

Still referring to FIG. 4, a cutaway, side view of an exemplary configuration of the impingement cooling assembly 86 is shown. The impingement cooling assembly 86 of FIG. 4 includes a perforated baffle plate 98. The baffle plate 98 may be formed by or otherwise disposed at (e.g., on, adjacent, or proximate) the side housing body 82. The baffle plate 98 may extend about (e.g., completely around) the rotational axis 28). The side housing body 82, the side plate 84, and the baffle plate 98 of FIG. 4 form a coolant passage 100 of the impingement cooling assembly 86.

Figure 5B:
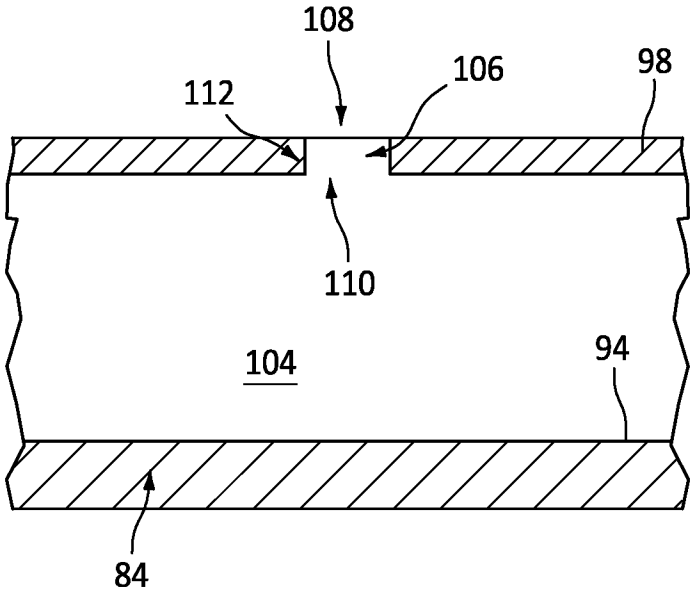
FIGS. 5A-B illustrate different coolant nozzle configurations of an impingement cooling assembly for the engine housing of FIG. 4, in accordance with one or more embodiments of the present disclosure.
Figure 5A:
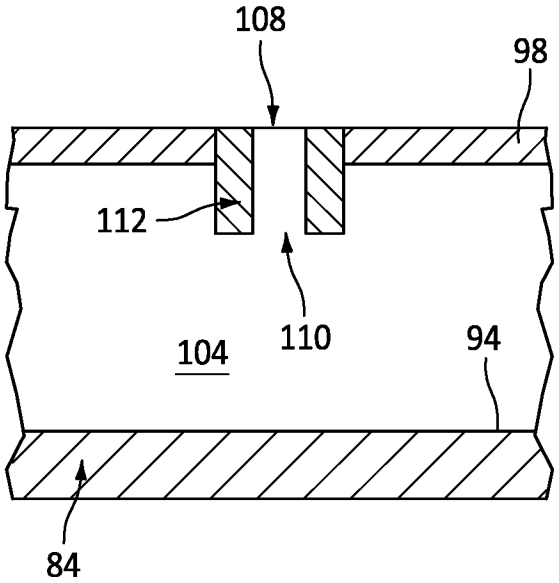

The coolant passage 100 includes an inlet plenum 102, an outlet plenum 104, and a plurality of impingement cooling holes 106 of the impingement cooling assembly 86. The inlet plenum 102 is formed between (e.g., axially between) the side housing body 82 and the baffle plate 98. The outlet plenum 104 is formed between (e.g., axially between) the baffle plate 98 and the side plate 84 (e.g., the outer side 94) with the outlet plenum 104 disposed axially inward of the inlet plenum 102. Each of the inlet plenum 102 and the outlet plenum 104 may extend about (e.g., completely around) the rotational axis 28 within the respective side housing assemblies 54. The baffle plate 98 forms the impingement cooling holes 106. Each of the impingement cooling holes 106 extends through the baffle plate 98 from the inlet plenum 102 to the outlet plenum 104. Each of the impingement cooling holes 106 extends between and to a cooling hole inlet 108 of each respective cooling hole 106 and a cooling hole outlet 110 of each respective cooling hole 106. The cooling hole inlet 108 is disposed at (e.g., on, adjacent, or proximate) the inlet plenum 102. The cooling hole outlet 110 is disposed at (e.g., on, adjacent, or proximate) the outlet plenum 104. The baffle plate 98 forms a nozzle 112 of each of the impingement cooling holes 106 at the cooling hole outlet 110. As shown in FIG. 5A, the nozzle 112 may extend into the outlet plenum 104 such that the cooling hole outlet 110 is spaced (e.g., axially spaced) from surrounding portions of the baffle plate 98. As shown in FIG. 5B, the nozzle 112 may alternatively be configured such that the cooling hole outlet 110 is flush with the surrounding portions of the baffle plate 98. The present disclosure, however, is not limited to the foregoing exemplary configurations of the nozzle 112. The inlet plenum 102 is connected in fluid communication with a coolant inlet of the coolant passage 100 to direct a coolant into the inlet plenum 102 from the coolant inlet. The outlet plenum 104 is connected in fluid communication with a coolant outlet of the coolant passage 100 to direct the coolant out of the outlet plenum 104 to the coolant outlet.

During operation of the engine assembly 10 (see FIG. 1), a coolant fluid is directed through the coolant passage 100 along a coolant flow path 114 as shown, for example, in FIG. 4. Examples of the coolant include air, water, ethylene glycol, ammonia ($NH_3$), liquified or gaseous hydrogen ($H_2$), supercritical carbon dioxide ($sCO_2$) or other fluids in a supercritical state, and the like. The coolant is directed into the inlet plenum 102. The coolant from the inlet plenum 102 is directed through the impingement cooling holes 106, from the cooling hole inlet 108 to the cooling hole outlet 110 toward and onto the side plate 84 (e.g., the outer side 94). The nozzle 112 for each of the impingement cooling holes 106 forms a coolant jet 116 impinging (e.g., orthogonally impinging) on one or more surfaces of the side plate 84 at (e.g., on, adjacent, or proximate) the outer side 94. Impingement of the coolant on the side plate 84 cools the side plate 84, for example, by facilitating greater convective heat transfer from the side plate 84 to the coolant compared to at least some other conventional passage cooling configurations. After impinging on the side plate 84, the coolant flows through the outlet plenum 104 to exit the respective side housing assembly 54 (e.g., through the coolant outlet). The nozzle 112 for each of the impingement cooling holes 106 may have a free or a submerged and/or confined jet impingement configuration. For example, the nozzle 112 may direct the coolant jet 116 into an ambient gas of the outlet plenum 104 (e.g., a free jet impingement configuration). Alternatively, the nozzle 112 may direct the coolant jet 116 into the outlet plenum 104 which outlet plenum 104 is filled or substantially filled by the coolant (e.g., a submerged and/or confined jet impingement configuration). The present disclosure, however, is not limited to the foregoing exemplary jet impingement configurations). A density of the impingement cooling holes 106 (e.g., a number of impingement cooling holes relative to the outer side 94 surface area) and/or a flow rate of the coolant may be selected to control an average heat convective heat transfer coefficient of the side plate 84. The greater convective heat transfer of the side plate 84 facilitated by the impingement cooling assembly 86 may allow the engine 12 (see FIG. 1) to be operated with a higher heat flux from the rotor cavity 62 (e.g., a combustion chamber; see FIG. 3) while still maintaining the side plate 84 below safe operating temperature limits. Accordingly, the impingement cool assembly 86 may facilitate improved power density for the associated engine 12.

Figure 6:
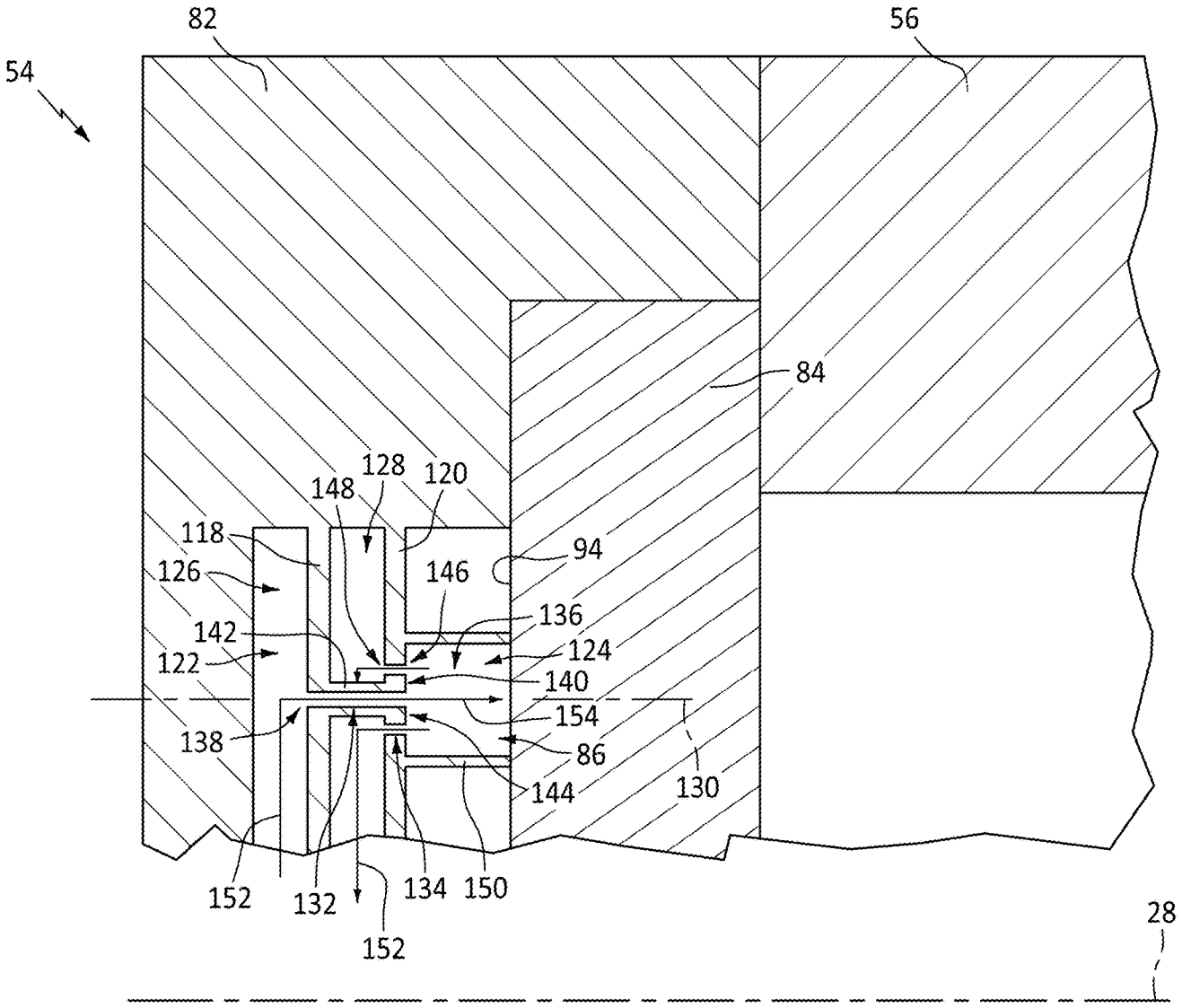
FIG. 6 illustrates a cutaway view of a portion of another engine housing for the rotor assembly of FIG. 2, in accordance with one or more embodiments of the present disclosure.

FIG. 6 illustrates a cutaway, side view of another exemplary configuration of the side housing assembly 54 and the impingement cooling assembly 86. The impingement cooling assembly 86 of FIG. 6 includes a first baffle plate 118 and a second baffle plate 120. Each of the first baffle plate 118 and the second baffle plate 120 may be formed by or otherwise disposed at (e.g., on, adjacent, or proximate) the side housing body 82. The first baffle plate 118 and the second baffle plate 120 may be formed by a single baffle plate body (e.g., the first baffle plate 118 and the second baffle plate may be a unitary structure) or two discrete baffle plate bodies. Each of the first baffle plate 118 and the second baffle plate 120 may extend about (e.g., completely around) the rotational axis 28). The first baffle plate 118 is disposed axially outward of and axially spaced from the second baffle plate 120 relative to the rotational axis 28. The side housing body 82, the side plate 84, and the first baffle plate 118 and the second baffle plate 120 of FIG. 6 form a coolant passage 122 and a plurality of coolant cells 124 and of the impingement cooling assembly 86.

The coolant passage 122 includes an inlet plenum 126 and an outlet plenum 128. The inlet plenum 126 is formed between (e.g., axially between) the side housing body 82 and the first baffle plate 118. The outlet plenum 128 is formed between (e.g., axially between) the first baffle plate 118 and the second baffle plate 120 with the outlet plenum 128 disposed axially inward of the inlet plenum 126. Each of the inlet plenum 126 and the outlet plenum 128 may extend about (e.g., completely around) the rotational axis 28 within the respective side housing assemblies 54. The inlet plenum 126 is connected in fluid communication with a coolant inlet of the coolant passage 122 to direct a coolant into the inlet plenum 126 from the coolant inlet. The outlet plenum 128 is connected in fluid communication with a coolant outlet of the coolant passage 122 to direct the coolant out of the outlet plenum 128 to the coolant outlet.

Each of the coolant cells 124 extends along a cell axis 130. The cell axis 130 may be oriented parallel to or substantially parallel to the rotational axis 28. Each of the coolant cells 124 forms one or more impingement cooling holes 132, one or more coolant outlet holes 134, and an impingement cooling cavity 136.

The coolant cell 124 of FIG. 6 forms one impingement cooling hole 132, which impingement cooling hole 132 extends along the cell axis 130. The present disclosure, however, is not limited to any particular quantity or location for the impingement cooling holes 132 for the coolant cell 124. The impingement cooling hole 132 of FIG. 6 extends between and to the inlet plenum 126 and the impingement cooling cavity 136. The impingement cooling hole 132 of FIG. 6 extends between and to a cooling hole inlet 138 of the impingement cooling hole 132 and a cooling hole outlet 140 of the impingement cooling hole 132. The impingement cooling hole 132 of FIG. 6 extends through the first baffle plate 118 and the second baffle plate 120 between the cooling hole inlet 138 and the cooling hole outlet 140. The cooling hole inlet 138 is disposed at (e.g., on, adjacent, or proximate) the first baffle plate 118 (e.g., an outer axial side of the first baffle plate 118). The cooling hole outlet 140 is disposed at (e.g., on, adjacent, or proximate) the second baffle plate 120 (e.g., an inner axial side of the second baffle plate 120). The coolant cell 124 of FIG. 6 includes an impingement cooling hole sidewall 142 extending between and to the first baffle plate 118 and the second baffle plate 120 to form a portion of the impingement cooling hole 132 between and to the first baffle plate 118 and the second baffle plate 120. The impingement cooling hole sidewall 142 may be formed by the first baffle plate 118 and/or the second baffle plate 120 or otherwise mounted between and connected to the first baffle plate 118 and the second baffle plate 120. The coolant cell 124 of FIG. 6 forms a nozzle 144 of the impingement cooling hole 132 at the cooling hole outlet 140. The nozzle 144 may be configured similar to the nozzle 112 (see FIGS. 4, 5A, and 5B), as previously discussed.

The coolant cell 124 of FIG. 6 forms the coolant outlet holes 134 radially outward of the impingement cooling hole 132 and the cell axis 130. The coolant outlet holes 134 may be circumferentially arrayed or distributed about the cell axis 130. Each of the coolant outlet holes 134 of FIG. 6 extends between and to impingement cooling cavity 136 and the outlet plenum 128. Each of the coolant outlet holes 134 extends between and to hole inlet 146 of the respective coolant outlet hole 134 and a hole outlet 148 of the respective coolant outlet hole 134. The coolant outlet holes 134 of FIG. 6 extend through the second baffle plate 120 between the hole inlet 146 and the hole outlet 148. The hole inlet 146 is disposed at (on, adjacent, or proximate) the impingement cooling cavity 136. The hole outlet 148 is disposed at (e.g., on, adjacent, or proximate) the outlet plenum 128.

The impingement cooling cavity 136 is formed by and between (e.g., axially between) the second baffle plate 120 and the side plate 84. The impingement cooling cavity 136 is further formed by a cooling cavity sidewall 150 of the coolant cell 124 of FIG. 6. The cooling cavity sidewall 150 extends about (e.g., completely around) the cell axis 130 to circumscribe the impingement cooling cavity 136. The cooling cavity sidewall 150 extends between and to the second baffle plate 120 and the side plate 84 (e.g., the outer side 94). The cooling cavity sidewall 150 may be formed by the second baffle plate 120, mounted to the second baffle plate 120, or otherwise disposed between and connected to the second baffle plate 120 and the side plate 84.

During operation of the engine assembly 10 (see FIG. 1), the coolant fluid is directed through the coolant passage 122 along a coolant flow path 152 as shown, for example, in FIG. 6. The coolant is directed into the inlet plenum 126. The coolant from the inlet plenum 126 is directed through the impingement cooling holes 132, from the cooling hole inlet 138 to the cooling hole outlet 140 toward and onto the side plate 84 (e.g., the outer side 94). The nozzle 144 for each of the impingement cooling holes 132 forms a coolant jet 154 impinging (e.g., orthogonally impinging) on one or more surfaces of the side plate 84 at (e.g., on, adjacent, or proximate) the outer side 94 and within the impingement cooling cavity 136. Impingement of the coolant on the side plate 84 cools the side plate 84, for example, by facilitating greater convective heat transfer from the side plate 84, as previously discussed. After impinging on the side plate 84, the coolant flows from the impingement cooling cavity 136, through the coolant outlet holes 134, and through the outlet plenum 128 to exit the respective side housing assembly 54 (e.g., through the coolant outlet).

Figure 7:
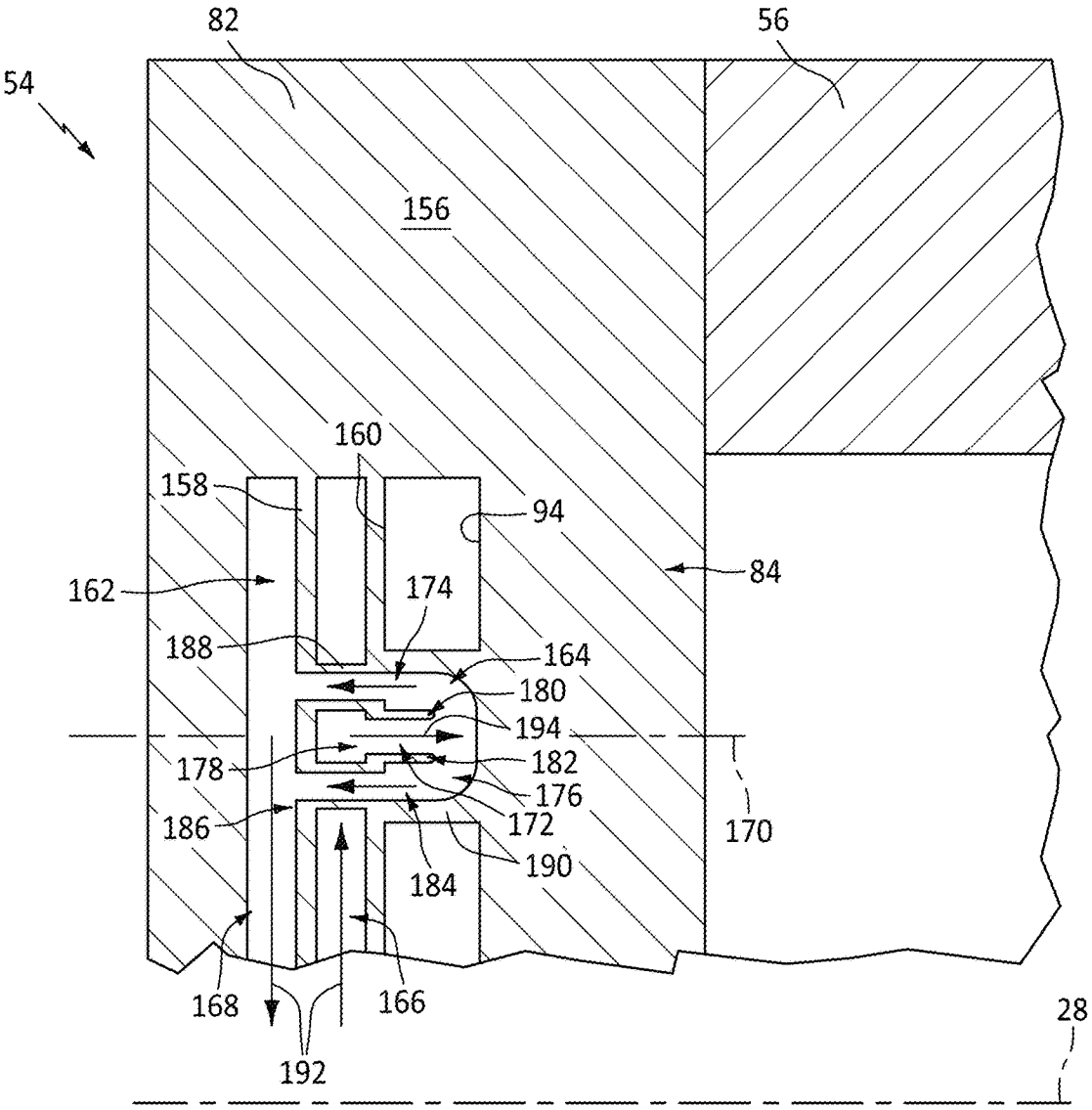
FIG. 7 illustrates a cutaway view of a portion of another engine housing for the rotor assembly of FIG. 2, in accordance with one or more embodiments of the present disclosure.

FIG. 7 illustrates a cutaway, side view of another exemplary configuration of the side housing assembly 54 and the impingement cooling assembly 86. For the side housing assembly 54 of FIG. 7, the side housing body 82 and the side plate 84 may be a unitary structure 156. The term "unitary structure" as used herein means a single component, wherein all elements of the side housing body 82 and the side plate 84 are an inseparable body (e.g., formed of a single material, or a weldment of independent elements, etc.). The unitary structure 156 of the side housing body 82 and the side plate 84 may be formed in a single process (e.g., an additive manufacturing process, etc.) or may be a weldment of the side housing body 82 and the side plate 84. The unitary structure 156 may facilitate simplified manufacturing and assembly of the side housing assembly 54. For example, the side housing body 82 and the side plate 84 forming the unitary structure 156 may obviate the use of seals (e.g., coolant fluid seals) between the side housing body 82 and the side plate 84, between the side housing body 82 and one or more baffle plates, and/or between other components of the side housing assembly 54. Moreover, side housing body 82 and/or side plate 84 wear caused by relative sliding or other movement between the side housing body 82 and the side plate 84 may be eliminated.

The impingement cooling assembly 86 of FIG. 7 includes a first baffle plate 158 and a second baffle plate 160. Each of the first baffle plate 158 and the second baffle plate 160 may be formed by the unitary structure 156 (e.g., the first baffle plate 158 and the second baffle plate 160 may be portions of the unitary structure 156). Each of the first baffle plate 158 and the second baffle plate 160 may extend about (e.g., completely around) the rotational axis 28). The first baffle plate 158 is disposed axially outward of and axially spaced from the second baffle plate 160 relative to the rotational axis 28. The unitary structure 156 and its side housing body 82, side plate 84, first baffle plate 158, and the second baffle plate 160 of FIG. 7 form a coolant passage 162 and a plurality of coolant cells 164 and of the impingement cooling assembly 86.

The coolant passage 162 includes an inlet plenum 166 and an outlet plenum 168. The inlet plenum 166 is formed between (e.g., axially between) the first baffle plate 158 and the second baffle plate 160. The outlet plenum 168 is formed between (e.g., axially between) the side housing body 82 and the first baffle plate 158 with the outlet plenum 168 disposed axially outward of the inlet plenum 166. Each of the inlet plenum 166 and the outlet plenum 168 may extend about (e.g., completely around) the rotational axis 28 within the respective side housing assemblies 54. The inlet plenum 166 is connected in fluid communication with a coolant inlet of the coolant passage 162 to direct a coolant into the inlet plenum 166 from the coolant inlet. The outlet plenum 168 is connected in fluid communication with a coolant outlet of the coolant passage 162 to direct the coolant out of the outlet plenum 168 to the coolant outlet.

Each of the coolant cells 164 extends along a cell axis 170. The cell axis 170 may be oriented parallel to or substantially parallel to the rotational axis 28. Each of the coolant cells 164 forms one or more impingement cooling holes 172, one or more coolant outlet holes 174, and an impingement cooling cavity 176.

The coolant cell 164 of FIG. 7 forms one impingement cooling hole 172, which impingement cooling hole 172 extends along the cell axis 170. The present disclosure, however, is not limited to any particular quantity or location for the impingement cooling holes 172 for the coolant cell 164. The impingement cooling hole 172 of FIG. 7 extends between and to the inlet plenum 166 and the impingement cooling cavity 176. The impingement cooling hole 172 of FIG. 7 extends between and to a cooling hole inlet 178 of the impingement cooling hole 172 and a cooling hole outlet 180 of the impingement cooling hole 172. The impingement cooling hole 172 of FIG. 7 extends through the second baffle plate 160 between the cooling hole inlet 178 and the cooling hole outlet 180. The cooling hole inlet 178 is disposed at (e.g., on, adjacent, or proximate) the second baffle plate 160 (e.g., an outer axial side of the second baffle plate 160). The cooling hole outlet 180 is disposed at (e.g., on, adjacent, or proximate) the impingement cooling cavity 176. The coolant cell 164 of FIG. 7 forms a nozzle 182 of the impingement cooling hole 172 at the cooling hole outlet 180. The nozzle 182 may be configured similar to the nozzle 112 (see FIGS. 4, 5A, and 5B), as previously discussed.

The coolant cell 164 of FIG. 7 forms the coolant outlet holes 174 radially outward of the impingement cooling hole 172 and the cell axis 170. The coolant outlet holes 174 may be circumferentially arrayed or distributed about the cell axis 170. Each of the coolant outlet holes 174 of FIG. 7 extends between and to impingement cooling cavity 176 and the outlet plenum 168. Each of the coolant outlet holes 174 extends between and to hole inlet 184 of the respective coolant outlet hole 174 and a hole outlet 186 of the respective coolant outlet hole 174. The coolant outlet holes 174 of FIG. 7 extend through the first baffle plate 158 and the second baffle plate 160 between the hole inlet 184 and the hole outlet 186. The hole inlet 184 is disposed at (on, adjacent, or proximate) the impingement cooling cavity 176. The hole outlet 186 is disposed at (e.g., on, adjacent, or proximate) the outlet plenum 168. The coolant cell 164 of FIG. 7 includes an outlet hole sidewall 188 for each of the coolant outlet holes 174. The outlet hole sidewall 188 extends between and to the first baffle plate 158 and the second baffle plate 160 to form a portion of a respective one of the coolant outlet holes 174 between and to the first baffle plate 158 and the second baffle plate 160. The outlet hole sidewall 188 may be formed by the unitary structure 156 (e.g., the outlet hole sidewall 188 may be a portion of the unitary structure 156).

The impingement cooling cavity 176 is formed by and between (e.g., axially between) the second baffle plate 160 and the side plate 84. The impingement cooling cavity 176 is further formed by a cooling cavity sidewall 190 of the coolant cell 164 of FIG. 7. The cooling cavity sidewall 190 extends about (e.g., completely around) the cell axis 170 to circumscribe the impingement cooling cavity 176. The cooling cavity sidewall 190 extends between and to the second baffle plate 160 and the side plate 84 (e.g., the outer side 94). The cooling cavity sidewall 190 may be formed by the unitary structure 156 (e.g., the cooling cavity sidewall 190 may be a portion of the unitary structure 156).

During operation of the engine assembly 10 (see FIG. 1), the coolant fluid is directed through the coolant passage 162 along a coolant flow path 192 as shown, for example, in FIG. 7. The coolant is directed into the inlet plenum 166. The coolant from the inlet plenum 166 is directed through the impingement cooling holes 172, from the cooling hole inlet 178 to the cooling hole outlet 180 toward and onto the side plate 84 (e.g., the outer side 94). The nozzle 182 for each of the impingement cooling holes 172 forms a coolant jet 194 impinging (e.g., orthogonally impinging) on one or more surfaces of the side plate 84 at (e.g., on, adjacent, or proximate) the outer side 94 and within the impingement cooling cavity 176. Impingement of the coolant on the side plate 84 cools the side plate 84, for example, by facilitating greater convective heat transfer from the side plate 84, as previously discussed. After impinging on the side plate 84, the coolant flows from the impingement cooling cavity 176, through the coolant outlet holes 174, and through the outlet plenum 168 to exit the respective side housing assembly 54 (e.g., through the coolant outlet).

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected, or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements.

The invention claimed is:

1. An engine housing for an aircraft rotary engine, the engine housing comprising:

a rotor housing including a rotor housing body, the rotor housing body extends about an axis to form a rotor cavity of the engine housing, and the rotor housing body extends between and to a first axial end and a second axial end; and a side housing assembly including a side housing body, a side plate, and an impingement cooling assembly, the side housing body is disposed at the first axial end, the side plate is disposed axially between the rotor housing body and the side housing body, the side plate includes an inner side, an outer side, and a perimeter edge extending from the inner side to the outer side, and the inner side further forms the rotor cavity, and the impingement cooling assembly includes a first baffle plate, the first baffle plate is disposed between the side housing body and the side plate, the side housing body, the side plate, and the first baffle plate form a coolant passage of the impingement cooling assembly, the coolant passage includes an inlet plenum and a plurality of impingement cooling holes, the first baffle plate forms the plurality of impingement cooling holes, each impingement cooling hole of the plurality of impingement cooling holes includes a cooling hole inlet and a cooling hole outlet, the cooling hole inlet is disposed at the inlet plenum, and each impingement cooling hole of the plurality of impingement cooling holes is configured to direct a coolant from the inlet plenum toward and onto the outer side from the cooling hole outlet.

2. The engine housing of claim 1, wherein the inlet plenum is formed by the side housing body and the first baffle plate.

3. The engine housing of claim 1, wherein the coolant passage further includes an outlet plenum, and the outlet plenum is formed by the first baffle plate and the side plate.

4. The engine housing of claim 3, wherein the cooling hole outlet is disposed at the outlet plenum.

5. The engine housing of claim 1, wherein the impingement cooling assembly further includes a second baffle plate disposed between the side housing body and the side plate, the second baffle plate is axially spaced from the first baffle plate, the coolant passage further includes an outlet plenum, and the outlet plenum is formed by one or both of the first baffle plate and the second baffle plate.

6. The engine housing of claim 5, wherein the inlet plenum is formed by and between the first baffle plate and the second baffle plate.

7. The engine housing of claim 5, wherein the outlet plenum is formed by and between the first baffle plate and the second baffle plate.

8. The engine housing of claim 5, wherein the side housing body, the side plate, the first baffle plate, and the second baffle plate form a plurality of coolant cells of the impingement cooling assembly, each coolant cell of the plurality of coolant cells includes at least one impingement cooling hole of the plurality of impingement cooling holes, one or more coolant outlet holes, and an impingement cooling cavity, the at least one impingement cooling hole extends between and connects the inlet plenum and the impingement cooling cavity, the one or more coolant outlet holes extend between and connect the outlet plenum and the impingement cooling cavity, and the impingement cooling cavity is disposed at the outer side.

9. The engine housing of claim 8, wherein the at least one impingement cooling hole extends through one of the first baffle plate or the second baffle plate.

10. The engine housing of claim 8, wherein the at least one impingement cooling hole extends through the first baffle plate and the second baffle plate.

11. The engine housing of claim 8, wherein the impingement cooling cavity sidewall extends between and to the second baffle plate and the side plate, and the impingement cooling cavity sidewall circumscribes the impingement cooling cavity.

12. The engine housing of claim 1, wherein the side housing body, the side plate, and the first baffle plate form a unitary structure.

13. The engine housing of claim 12, wherein the impingement cooling assembly further includes a second baffle plate disposed between the side housing body and the side plate, and the second baffle plate further forms the unitary structure.

14. The engine housing of claim 13, wherein the second baffle plate is axially spaced from the first baffle plate, the coolant passage further includes an outlet plenum, and the outlet plenum is formed by one or both of the first baffle plate and the second baffle plate.

15. An engine housing for an aircraft rotary engine, the engine housing comprising:

a side housing assembly extending along an axis, the side housing assembly includes a side housing body, a side plate, and an impingement cooling assembly, the side housing body and the side plate extend about the axis, the side plate includes an inner axial side, an outer axial side, and a perimeter edge extending from the inner axial side to the outer axial side, the outer axial side is disposed at the side housing body, the impingement cooling assembly includes:

a baffle plate, the baffle plate, the side housing body, and the side plate form a coolant passage of the impingement cooling assembly axially between the side housing body and the outer axial side, the coolant passage extends about the axis, the coolant passage includes an inlet plenum and a plurality of impingement cooling holes, the baffle plate forms the plurality of impingement cooling holes, each impingement cooling hole of the plurality of impingement cooling holes includes a cooling hole inlet and a cooling hole outlet, the cooling hole inlet is disposed at the inlet plenum, and each impingement cooling hole of the plurality of impingement cooling holes is configured to direct a coolant from the inlet plenum toward and onto the outer side from the cooling hole outlet.

16. The engine housing of claim 15, wherein each impingement cooling hole of the plurality of impingement cooling holes extends axially from the cooling hole inlet to the cooling hole outlet to direct the coolant orthogonally toward and onto the outer side.

17. The engine housing of claim 15, wherein the baffle plate forms a nozzle for each impingement cooling hole of the plurality of impingement cooling holes at the cooling hole outlet, and the nozzle extends toward the outer side relative to a surrounding portion of the baffle plate.

18. An engine housing for an aircraft rotary engine, the engine housing comprising:

a rotor housing including a rotor housing body, the rotor housing body extends about an axis to form a rotor cavity of the engine housing; and a side housing assembly including a side housing body, a side plate, and an impingement cooling assembly, the side housing body is disposed mounted to the rotor housing body, the side plate is disposed axially between the rotor housing body and the side housing body, the side plate includes an inner side and an outer side, and the inner side further forms the rotor cavity, and the impingement cooling assembly includes at least one baffle plate, the at least one baffle plate is disposed axially between the side housing body and the side plate, the side housing body, the side plate, and the at least one baffle plate form a coolant passage of the impingement cooling assembly, the coolant passage includes a plurality of impingement cooling holes, an inlet plenum upstream of the plurality of impingement cooling holes, and an outlet plenum downstream of the plurality of impingement cooling holes, the at least one baffle plate separates the inlet plenum from the outlet plenum, each impingement cooling hole of the plurality of impingement cooling holes includes a cooling hole inlet and a cooling hole outlet, the cooling hole inlet is disposed at the inlet plenum, and each impingement cooling hole of the plurality of impingement cooling holes is configured to direct a coolant from the inlet plenum toward and onto the outer side from the cooling hole outlet.

19. The engine housing of claim 18, wherein the side housing body, the side plate, and the at least one baffle plate form a unitary structure.

20. The engine housing of claim 18, wherein the at least one baffle plate includes a first baffle plate and a second baffle plate axially spaced from the first baffle plate.

* * * * *